US006286817B1

(12) United States Patent
Grant

(10) Patent No.: US 6,286,817 B1
(45) Date of Patent: Sep. 11, 2001

(54) CARBURETOR FUEL BOWL HAVING FUEL LEVEL INDICATION

(76) Inventor: Barry Grant, 1450 McDonald Rd., Dahlonega, GA (US) 30533

( * ) Notice: Subject to any disclaimer, the term of this patent is extended or adjusted under 35 U.S.C. 154(b) by 0 days.

(21) Appl. No.: 09/389,907

(22) Filed: Sep. 3, 1999

(51) Int. Cl.[7] ..... F02M 5/12
(52) U.S. Cl. ..... 261/70; 73/323; 116/276
(58) Field of Search ..... 261/70, 71, 72.1, 261/DIG. 67; 73/323; 116/276

(56) References Cited

U.S. PATENT DOCUMENTS

| | | | | |
|---|---|---|---|---|
| 1,082,744 | * | 12/1913 | Goldberg | 261/70 X |
| 1,089,089 | * | 3/1914 | Stamps | 261/70 X |
| 1,172,578 | * | 2/1916 | Brinkman | 261/70 X |
| 2,808,102 | * | 10/1957 | Lidecker | 261/70 X |
| 2,963,939 | * | 12/1960 | Garey | 73/323 |
| 3,085,424 | * | 4/1963 | Berg | 116/276 X |
| 3,382,881 | * | 5/1968 | Charron | 261/70 X |
| 3,964,503 | * | 6/1976 | Kikuchi | 261/DIG. 67 |
| 4,335,825 | * | 6/1982 | Sakazume | 73/323 X |
| 4,376,490 | * | 3/1983 | Mizusaki | 73/323 X |
| 4,590,798 | * | 5/1986 | Yazaki | 73/323 |
| 4,620,441 | * | 11/1986 | Hendrickson | 73/323 X |
| 4,987,777 | * | 1/1991 | Bourret et al. | 116/276 X |
| 5,763,776 | * | 6/1998 | Birch et al. | 73/323 |

* cited by examiner

*Primary Examiner*—Richard L. Chiesa
(74) *Attorney, Agent, or Firm*—Thomas, Kayden, Horstemeyer & Risley

(57) ABSTRACT

The present invention relates to a fuel bowl for a carburetor for an internal combustion engine. The fuel bowl includes a fuel bowl housing (18) having an inner fuel cavity (22) and opposed lateral sides (54), and a sight glass (58) provided in at least one of the opposed lateral sides of the fuel bowl housing positioned such that the nominal operating fuel level within the fuel bowl is approximately level with the center of the sight glass. The sight glass includes an outer frame (62) and a clear panel (64), wherein the level of fuel contained within the inner fuel cavity of the fuel bowl can be viewed through the view window of the sight glass.

8 Claims, 5 Drawing Sheets

CARBURETOR FUEL BOWL HAVING FUEL LEVEL INDICATION

FIELD OF THE INVENTION

The invention relates generally to a carburetor fuel bowl. More particularly, the invention relates to a carburetor fuel bowl which clearly indicates the fuel level within the fuel bowl to the observer.

BACKGROUND OF THE INVENTION

Modern carburetors normally include fuel bowls that serve as local reservoirs for fuel that is supplied into the barrels of the carburetor and ultimately into the cylinders of a combustion engine. Typically, fuel bowls comprise an inner fuel cavity in which fuel is held, one or more inlet ports that receive fuel from the vehicle's fuel system, a fuel valve that opens and closes to control supply of fuel from the inlet port into the fuel cavity, and a float mechanism that regulates opening and closing of the fuel valve.

Before passing into the barrels of the carburetor, the fuel usually first flows through a fuel metering block which pre-emulsifies the fuel for later atomization within the carburetor barrels. In order for the metering blocks to function properly, the fuel held within the fuel bowl must be between certain predetermined levels. When the level of fuel within the fuel bowl is too low, the metering jets of the metering blocks are not supplied with fuel, resulting in inadequate supply of fuel to the carburetor barrels. On the other hand, when the level of fuel is too high within the fuel bowl, too much fuel can be delivered into the carburetor, resulting in inadequate combustion of the fuel within the engine.

Fuel bowls normally are provided with trickle holes that permit the carburetor user or service technician to observe how much fuel is contained within the fuel bowls. These trickle holes typically comprise threaded openings formed in the side of the fuel bowl that are adapted to receive a threaded trickle plug. To determine the level of fuel in the fuel bowls in such systems, the trickle plug is removed. Since the trickle hole is positioned in the fuel bowl such that the bottom edge of the hole is even with the nominal operating level of fuel for the fuel bowl, proper fuel levels are indicated when the fuel barely trickles out of the hole.

Although useful for indicating the amount of fuel in the fuel bowl, trickle holes present many disadvantages to the carburetor user. One problem with trickle holes is that the level of fuel contained within the fuel bowls cannot be determined without first removing the trickle plug with a tool. Another problem is that fuel is spilled when the trickle plug is removed if the fuel level is higher than the bottom edge of the trickle hole. This spillage creates a fire hazard and further creates a mess that should be cleaned up. A further problem with trickle holes relates to accuracy in fuel level measurement. Specifically, the trickling of fuel provides a very imprecise quantification of the amount of fuel contained in the fuel bowl. For instance, if the user wishes to operate the carburetor with relatively high levels of fuel within the fuel bowls, he or she must guess as to the level of fuel that will be contained within the fuel bowl by observing the rate of fuel flowing out from the trickle hole.

In response to the difficulties associated with conventional trickle holes and plugs, sight glasses have been used in place of metal trickle plugs. These sight glasses are made of polycarbonate material such as plexiglass and, like conventional trickle plugs, are provided with outer threads such that the sight glass can be directly threaded into the trickle hole.

Although permitting the user to view the level of fuel contained in the fuel bowls without the need of removing a trickle plug, these polycarbonate sight glasses create other problems. In that these sight glasses have polycarbonate threads, they are susceptible to damage from over-torquing. Further, because the positioning of conventional trickle holes is such that the bottom edge of the trickle hole is even with the nominal operating level for the fuel bowl, the fuel level within the fuel bowl is difficult to see. This problem is exacerbated by the fact that discoloration of the sight glass typically occurs after extended use in the fuel bowl. Moreover, polycarbonate sight glasses tend to fail from fatigue when used for extended periods of time.

Accordingly, it can be understood that it would be desirable to have a means of determining the level of fuel within a fuel bowl which permits the user to quickly and easily determine the fuel level without the need for tools and without spillage of fuel. The disclosure of the present invention provides one such means.

SUMMARY OF THE INVENTION

The present invention relates to a fuel bowl having fuel level indication. The fuel bowl comprises a fuel bowl housing having an inner fuel cavity and opposed lateral sides, and a sight glass provided in at least one of the opposed lateral sides of the fuel bowl housing positioned such that the nominal operating fuel level within the fuel bowl is approximately level with the center of the sight glass. The sight glass includes an outer frame and a clear panel, wherein the level of fuel contained within the inner fuel cavity of the fuel bowl can be viewed through the view window of the sight glass.

Constructed in this manner, the sight glass can be used to quickly determine the adequacy of the supply of fuel to the fuel bowl without the need for disassembly of the carburetor or the spillage of fuel. In addition, the sight glass further can be used as a fuel level adjustment aid.

The features and advantages of this invention will become apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Referring now in more detail to the drawings, in which like numerals indicate like parts throughout the several views, FIGS. 1–9 illustrate a fuel bowl constructed with accordance with the present invention.

Figure 1:
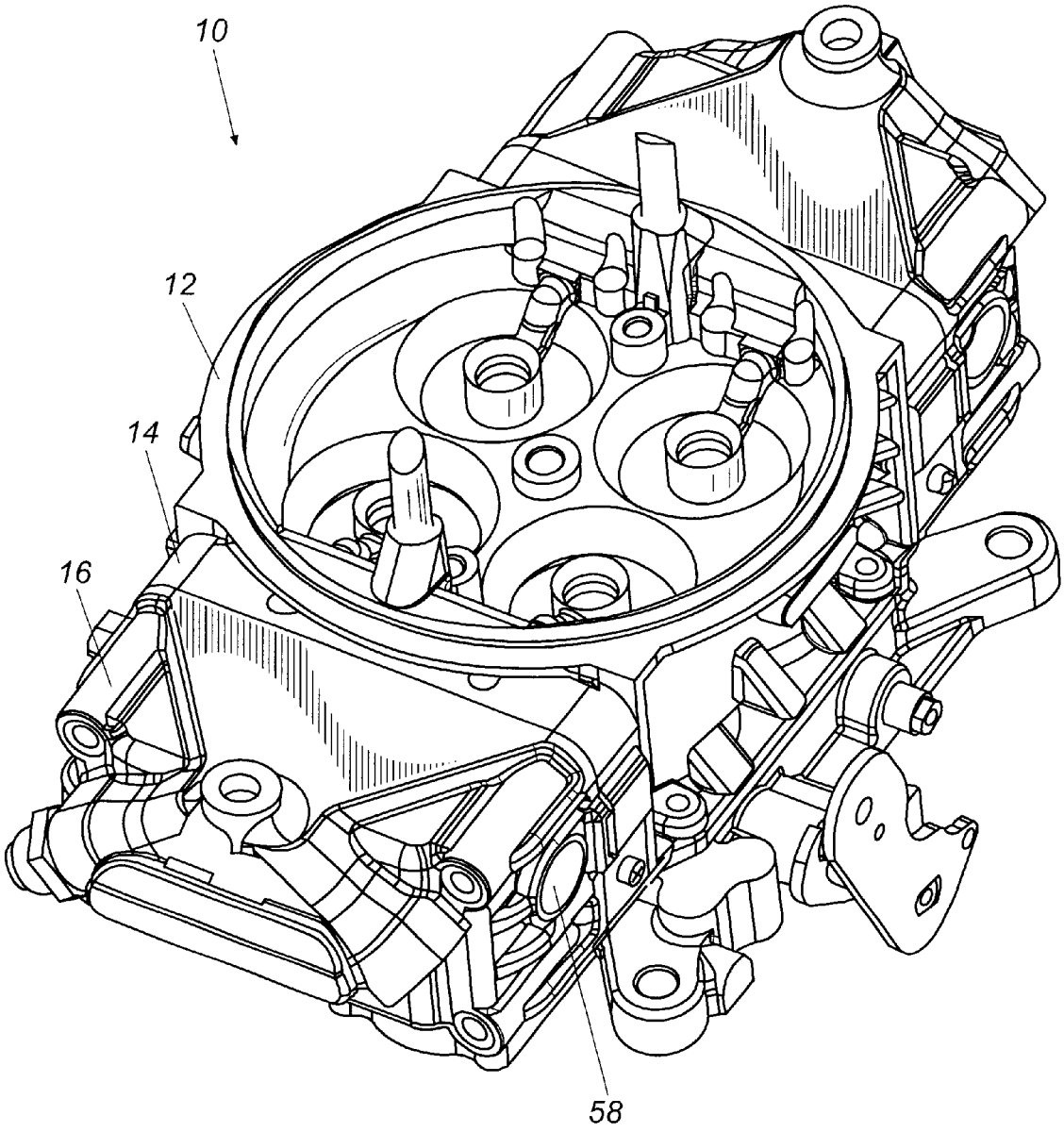
FIG. 1 is a top perspective view of a carburetor provided with fuel bowls constructed in accordance with the present invention.

FIG. 1 shows a combustion engine carburetor 10 of the type with which the present invention is used. As indicated in the figure, the carburetor includes a center section 12, a pair of fuel metering blocks 14 attached to the center section, and a pair of fuel bowls 16 attached to the metering blocks.

Figure 2:
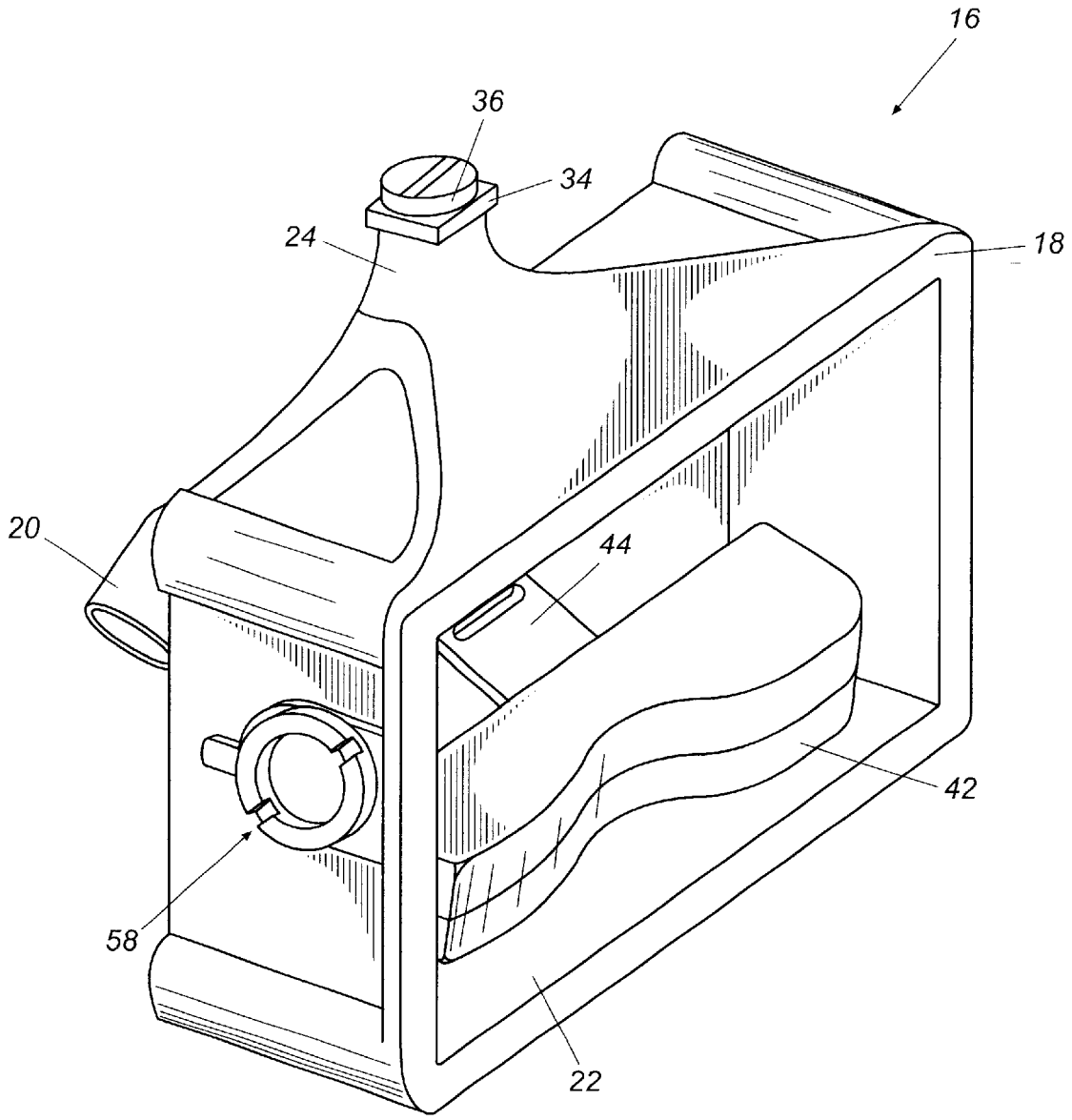
FIG. 2 is a side perspective view of a fuel bowl constructed in accordance with the present invention.
Figure 3:
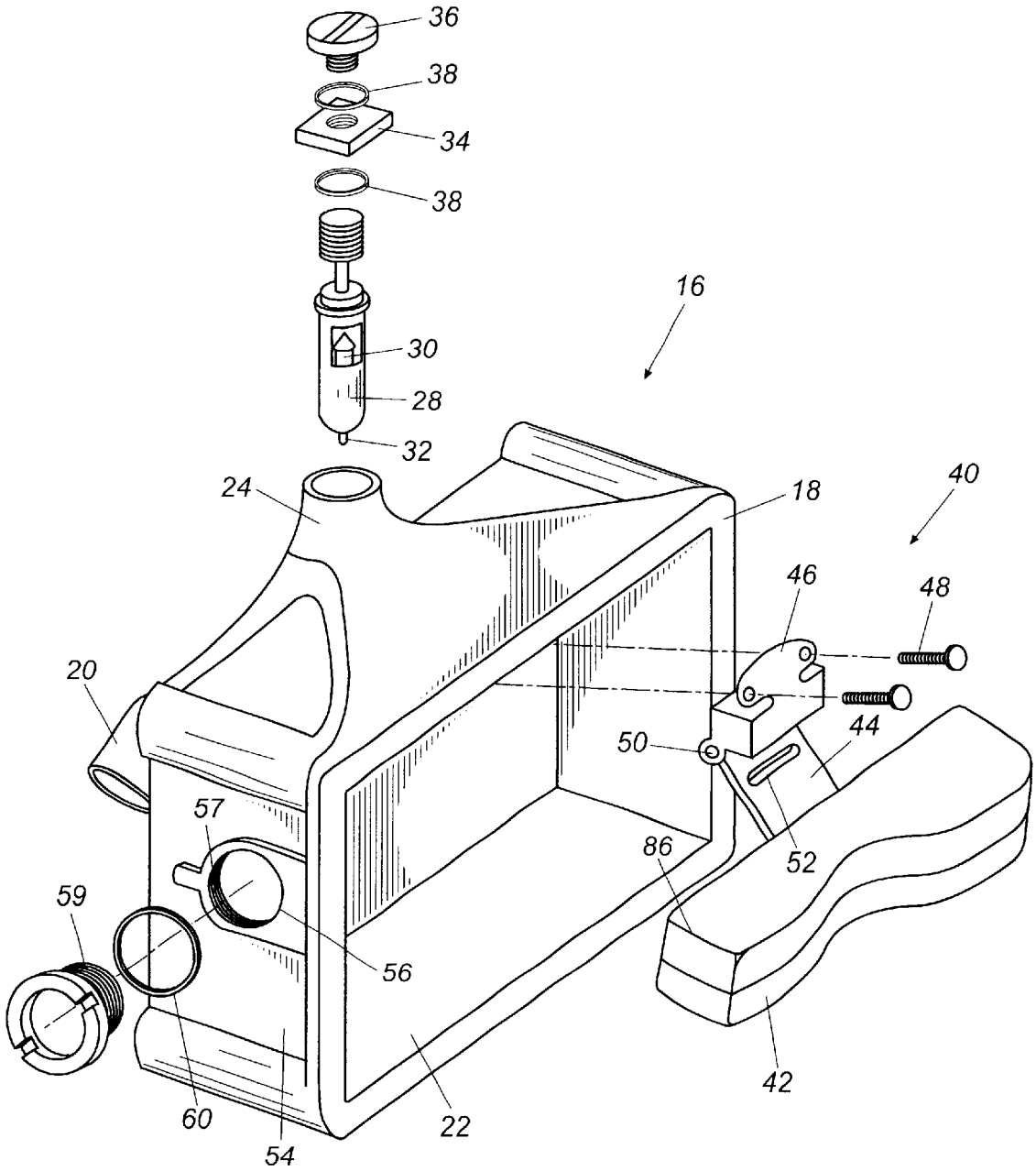
FIG. 3 is a exploded side perspective view of the fuel bowl shown in FIG. 2.

FIGS. 2 and 3 illustrate the fuel bowl shown in FIG. 1 in greater detail. As depicted in these figures, the fuel bowl 16 comprises a substantially rectilinear fuel bowl housing 18. Integrally formed within the housing is a pair of fuel inlet ports 20 through which fuel is supplied to the inner fuel cavity 22 of the housing. Also integrally formed with the fuel bowl housing 18 is a fuel valve housing 24. It is to be noted that, although the fuel inlet ports and fuel valve housing are described as being integrally formed with the fuel bowl housing, it will be appreciated that these features could, alternatively, be formed as separate parts that are individually secured to the housing.

As indicated in the exploded view of FIG. 3, the fuel valve housing 24 contains a fuel valve 26. Although capable of different construction, the fuel valve 26 typically comprises a valve body 28 and an inner valve element 30. When in the open position indicated in FIG. 3, a tip 32 of the valve element extends downwardly from the valve body 28. Typically, the fuel valve 26 further includes an adjustment nut 34 and a lock nut 36 as well as one or more washers 38. The adjustment nut and lock nut thread onto the valve body 28 and are used to adjust the activation point for the valve and can be used to change the fill level within the fuel bowl 16.

Disposed within the inner fuel cavity 22 of the fuel bowl 16 is a float mechanism 40. The float mechanism includes a float 42, a float lever arm 44, and a mounting bracket 46. As indicated in FIG. 3, the mounting bracket 46 is adapted to mount within the inner fuel cavity 22 of the fuel bowl housing 18 with one or more threaded fasteners 48. The float lever arm 44 is fixedly connected to the float 42 and pivotally connected to the mounting bracket 46 at a pivot point 50. Formed on the top side of the lever arm 44 is a raised portion 52 which, as is described below, is used to open and close the fuel valve 26 when the engine is in operation.

Provided in at least one of the lateral sides 54 of the fuel bowl housing 18 is a sight glass opening 56. This opening is positioned such that the center of the opening is even with the nominal operating fuel level for the fuel bowl. Typically, the opening includes helical threads 57 so as to receive external helical threads. These mating helical threads form means for mounting the sight glass at the fuel level of the fuel bowl. Other mounting means can be used, as may be suitable for the conditions in which the sight glass is used, such as adhesives, bayonet threads, a snap fit, a locking washer and other mechanical devices. As indicated in FIGS. 2 and 3, a resilient member such as an O-ring 60 typically is disposed between the sight glass 58 and the sight glass opening 56 to ensure an airtight seal therebetween.

Figure 4:
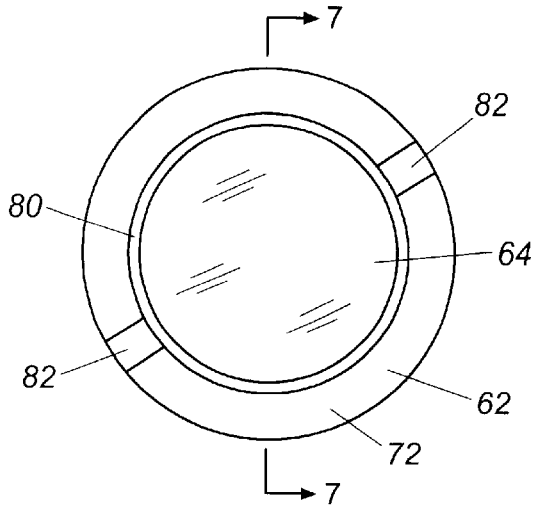
FIG. 4 is a front view of a sight glass used in the fuel bowl of FIGS. 2–3.
Figure 6:
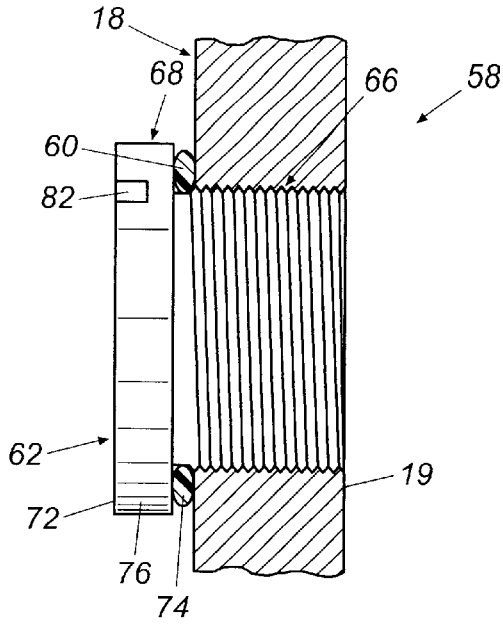
FIG. 6 is a side view of the sight glass shown in FIGS. 4–5.
Figure 5:
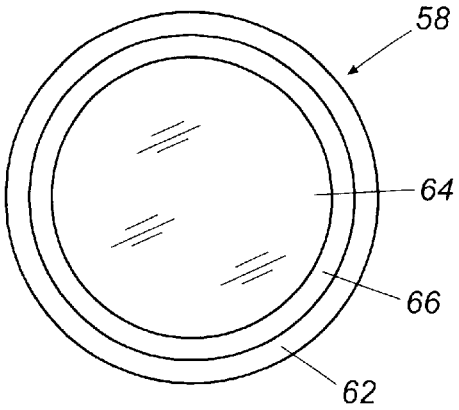
FIG. 5 is a rear view of the sight glass shown in FIG. 4.
Figure 7:
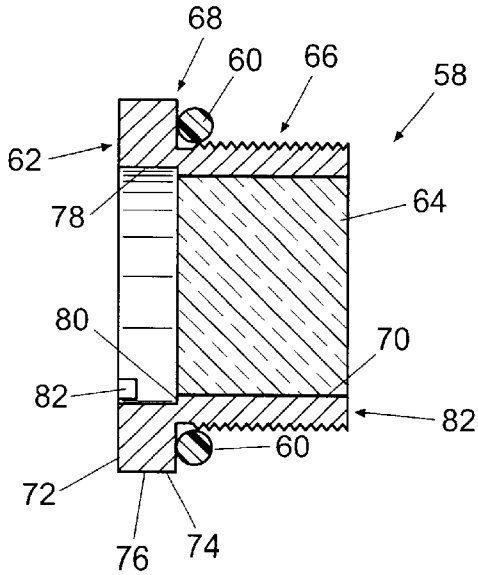
FIG. 7 is a cross-sectional side view of the sight glass taken along lines 7—7 shown in FIG. 4.

FIGS. 4–7 show the sight glass 58 in detail. As illustrated in these figures, the sight glass generally comprises an outer frame 62 and a clear panel 64 that functions as an inner view window. The outer frame includes a helically threaded portion 66 adapted for threading into the sight glass opening 56 of the fuel bowl housing 18, and a collar portion 68 which is positioned outside of the fuel bowl housing when the sight glass is threaded into the housing (FIG. 7). Typically, the threaded portion 66 and the collar portion 68 are unitarily formed together out of a metal material such as steel. As shown in FIG. 7, the threaded portion 66 is substantially cylindrical in shape and is provided with a substantially cylindrical passage 70 formed therein. The collar portion 68 is defined by substantially flat front and back surfaces 72 and 74, a substantially cylindrical outer periphery 76, and a substantially cylindrical inner passage 78. Accordingly, the collar portion is substantially ring-shaped. The inner passage 78 of the collar portion preferably is larger than the cylindrical passage 70 of the threaded portion such that an annular inner shoulder 80 is formed at the juncture of the collar portion and the threaded portion. As indicated in FIG. 4, the front surface 72 of the collar portion is provided with tool receiving means preferably in the form of a tool slot 82 that is adapted to receive a sight glass tightening tool such as a wide, flat blade screw driver (not shown). Preferably, the configuration of the collar portion 68 and the depth of the tool slot 82 are such that the panel 64 is recessed away from the tool slot (FIG. 7). This recessed orientation protects the panel from damage that otherwise could be caused by contact with the tightening tool or with other instruments used in association with the engine.

As illustrated in FIG. 6, the sight glass 58 is proportioned such that it does not protrude beyond the inside surface 19 of the fuel bowl housing, so as to avoid engagement with float 42. The clear panel 64 typically is constructed of a glass material. Although capable of alternative construction, the panel typically is formed directly in the threaded portion by pouring the glass in a molten state into the cylindrical passage 70 and curing the glass so as to fixedly position the glass in its solid state therein.

The primary elements of the fuel bowl having been described, the usage and operation of the fuel bowl, and particularly the sight glass 58, will now be discussed. If the level of fuel within the inner fuel cavity 22 of the fuel bowl is low during carburetor operation, the float 42 pivots downwardly to a fill position. When in the fill position, the raised portion 52 of the float lever arm 44 is out of contact with the tip 32 of the valve element 30 of the fuel valve 26. This permits the valve element to drop down and open the valve which, in turn, permits fuel to flow from one or more of the inlet ports 20, through the valve body 28, and into the fuel cavity 22. As fuel flows into the fuel cavity, the buoyant float begins to pivot upwardly until the raised portion of the float lever arm contacts the tip of the valve element and urges it upwardly to seat within the valve body to close the valve. The height of the fuel at which the valve is shut can be controlled with the adjustment nut 34. Specifically, turning of the adjustment nut changes the vertical positioning of the valve body and the height at which the raised portion of the float lever arm contacts the tip of the valve element.

Figure 9:
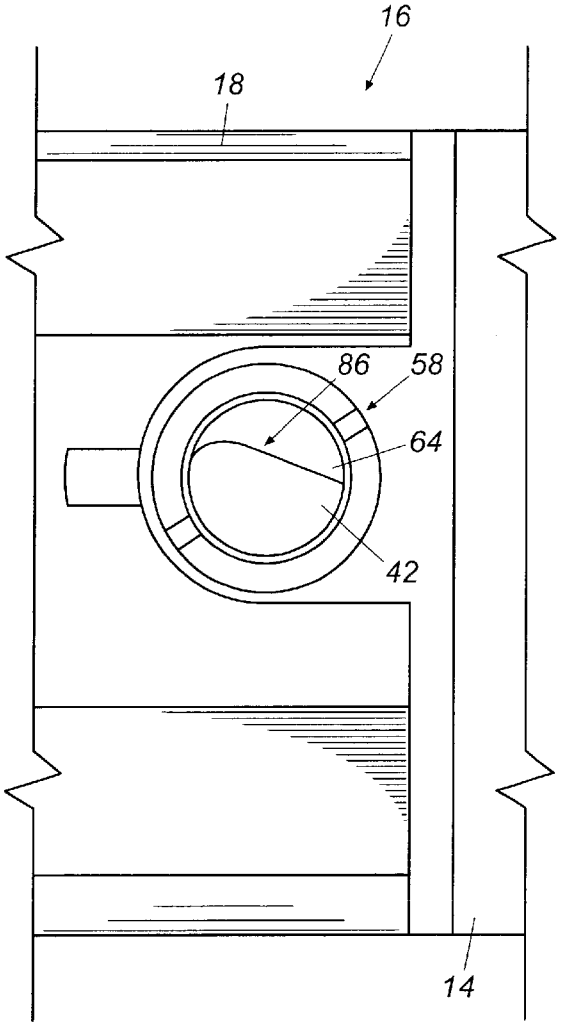
FIG. 9 is a partial side view of the fuel bowl showing a low fuel level.
Figure 8:
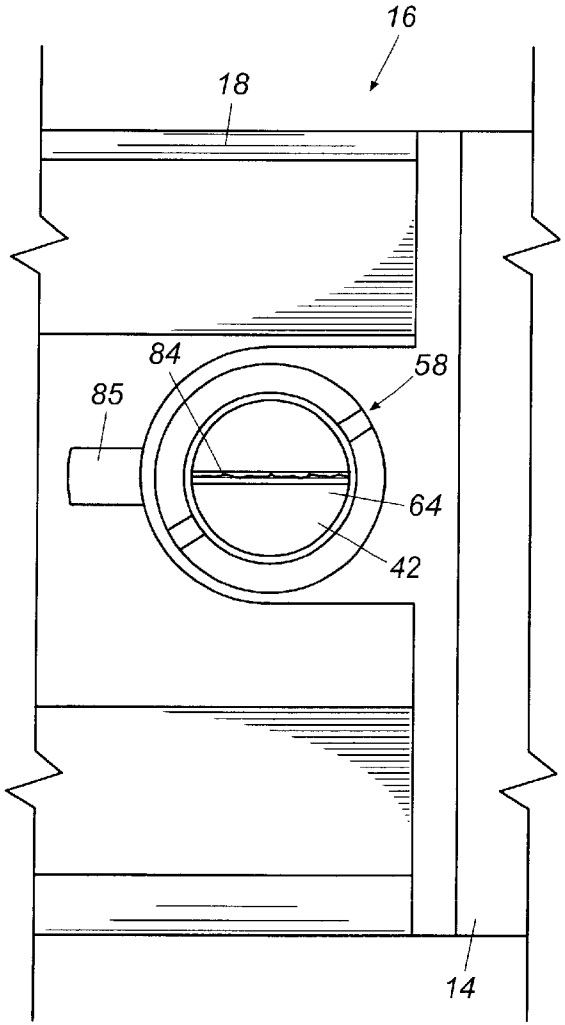
FIG. 8 is a partial side view of the fuel bowl showing a nominal operating fuel level.

During carburetor usage, the sight glass 58 can be used as a diagnostic tool to indicate functioning of the fuel bowl and the carburetor as a whole. In particular, the sight glass can be used to quickly determine the adequacy of the supply of fuel to the fuel bowl without the need for disassembly of the carburetor or the spillage of fuel. As indicated in FIGS. 8 and 9, the fuel level 84 (indicated by a wavy line) can be determined by simply looking through the view window 64 of the sight glass 58. FIG. 8 depicts an example nominal operating level of the fuel within the fuel bowl. As shown in this figure, the level of the fuel is approximately even with the center of the view window and with a raised rib 85 in the side of the fuel bowl under nominal operating conditions. Notably, the float 42 is also visible through the view window. Low fuel levels are clearly indicated when the fuel level is below the center of the view window or, as shown in FIG. 9, not visible through the view window. In such circumstances, the observer may be able to see the top edge 86 of the float 42. Such a low fuel level can indicate an insufficient supply of fuel to the fuel bowl or a damaged or defective float.

The sight glass 58 further can be used as a fuel level adjustment and specifically, if the user wishes to change the fill level within the fuel bowl to a higher or lower level, the user can adjust the fuel valve 26 in the manner described above and can clearly observe the altered fuel level through the sight glass. As identified above, conventional polycarbonate plugs do not provide this functionally because the trickle plugs which they replace normally are positioned not for fuel level viewing, but for fuel trickling from the base of the trickle hole.

In addition to the increased convenience and safety provided by the fuel bowl of the present invention, more accurate assessment of fuel levels within the fuel bowl can be made. In particular, by allowing the observer to directly view the fuel level, the guesswork normally associated with observation of the flow of fuel out of the trickle hole is removed. Accordingly, if the user wishes to have relatively high fuel levels within the fuel bowls, he or she need not estimate these levels from the amount of fuel that is spilled from the fuel bowl when the trickle plug is removed. In addition, the sight glass of the present invention avoids the drawbacks of polycarbonate sight glasses in that damage to the sight glass is prevented by the outer frame and view window discoloration is prevented by use of glass.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A fuel bowl for supplying gasoline to a carburetor of a combustion engine, said fuel bowl comprising:

a fuel bowl housing including lateral sides, an inner fuel cavity defined by said lateral sides for receiving and delivering fuel, a fuel input port extending through said housing for supplying fuel to said inner fuel cavity, and a sight glass opening formed through one of said lateral sides;

a fuel valve supported by said housing at said fuel input port for controlling the flow of fuel through said fuel input port into said inner fuel cavity, a float pivotally mounted in said inner fuel cavity of said fuel bowl housing for floating on fuel in said inner fuel cavity and actuating said fuel valve in response to the changing level of fuel in said inner fuel cavity and maintaining the fuel in said cavity at a nominal level that intersects said sight glass opening;

a sight glass closing said sight glass opening, said sight glass including:

an annular open ended side wall having opposed ends, an outer cylindrical surface and an inner cylindrical surface extending between said opposed ends, connector means formed on said outer cylindrical surface of said open ended side wall mounting said sight glass to said side of said fuel bowl housing in said sight glass opening, a collar mounted to one end of said open ended side wall of said sight glass of greater breadth than said sight glass opening for positioning outside said inner fuel cavity and limiting the movement of said sight glass into said sight glass opening, and a clear panel positioned in and supported by said inner cylindrical surface of said side wall between said inner end of said side wall and said collar, so that fuel in said inner fuel cavity is visible through said clear panel when the fuel in said inner fuel chamber is at its nominal level and intersects said sight glass opening.

2. The fuel bowl of claim 1, wherein said collar includes a tool receiving shape for rotating said sight glass.

3. The fuel bowl of claim 1, wherein said clear panel is supported solely by said inner cylindrical surface of said side wall of said sight glass.

4. The fuel bowl of claim 1, wherein said connector means on said outer cylindrical surface of said open ended side wall comprises helical threads.

5. The fuel bowl of claim 1, wherein said clear panel comprises glass.

6. The fuel bowl of claim 1, wherein said annular open ended side wall of said sight glass is formed of metal.

7. The fuel bowl of claim 1, and further including said fuel bowl housing having a visible mark that intersects said sight glass opening.

8. The fuel bowl of claim 1, wherein said clear panel is characterized by having been formed by pouring glass in a molten state into said open ended side wall and curing the glass to fix the glass to said side wall.

* * * * *